US010870214B2

(12) United States Patent
Wenning et al.

(10) Patent No.: US 10,870,214 B2
(45) **Date of Patent: *Dec. 22, 2020**

(54) ROUTER LIFT

(71) Applicant: Rockler Companies, Inc., Medina, MN (US)

(72) Inventors: Daniel Lloyd Wenning, Minnetonka, MN (US); Steven Allan Anderson, Eden Prairie, MN (US); Steven Donald Krohmer, Maple Grove, MN (US)

(73) Assignee: ROCKLER COMPANIES, INC., Medina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/673,135

(22) Filed: Nov. 4, 2019

(65) Prior Publication Data

US 2020/0061864 A1 Feb. 27, 2020

Related U.S. Application Data

(63) Continuation of application No. 15/441,348, filed on Feb. 24, 2017, now Pat. No. 10,486,327.

(60) Provisional application No. 62/299,845, filed on Feb. 25, 2016.

(51) Int. Cl.
*B27C 5/02* (2006.01)
*B27C 5/10* (2006.01)

(52) U.S. Cl.
CPC . *B27C 5/02* (2013.01); *B27C 5/10* (2013.01)

(58) Field of Classification Search
CPC .. B25H 1/005; B27C 5/02; B27C 5/10; B23Q 5/22; B23Q 5/32; B23Q 5/326; B23Q 5/40; B23Q 5/46; B23C 7/00; B23C 7/06
See application file for complete search history.

(56) References Cited

U.S. PATENT DOCUMENTS 5,139,061 A * 8/1992 Neilson ..... B27C 5/02 144/134.1
6,488,455 B1 * 12/2002 Staebler ..... B23C 1/20 144/136.95
6,863,480 B1 * 3/2005 Taylor ..... B27C 5/02 144/136.95
7,481,253 B2 * 1/2009 Hummel ..... B27C 5/02 144/136.95

(Continued)

*Primary Examiner* — Matthew Katcoff
(74) *Attorney, Agent, or Firm* — Mai-Tram D. Lauer; Westman, Champlin & Koehler, P.A.

(57) ABSTRACT

An apparatus configured for use with a router includes a top plate, a carriage, a threaded shaft, a first adjustment mechanism, and a second adjustment mechanism. The carriage is configured to at least partially surround the router. The threaded shaft has a first longitudinal axis, the shaft connecting the top plate and carriage so that the carriage is movable along the first longitudinal axis. Rotation of the first adjustment mechanism about the first longitudinal axis in a first direction and for a number of rotations is configured to rotate the threaded shaft about the first longitudinal axis in the first direction at a first speed. Rotation of the second adjustment mechanism about a second longitudinal axis for the number of rotations is configured to rotate the threaded shaft about the first longitudinal axis in the first direction and at a second speed that is faster than the first speed.

16 Claims, 9 Drawing Sheets

(56) References Cited

U.S. PATENT DOCUMENTS

| | | | | |
|---|---|---|---|---|
| 7,559,347 | B2 * | 7/2009 | Hummel | B27C 5/02 144/136.1 |
| 7,921,888 | B2 * | 4/2011 | Sommerville | B27C 5/02 144/253.1 |
| 9,039,000 | B2 * | 5/2015 | Smith | B25H 1/005 144/136.1 |

* cited by examiner

ROUTER LIFT

CROSS REFERENCE TO RELATED APPLICATIONS

This application is a continuation of U.S. patent application Ser. No. 15/441,348, filed on Feb. 24, 2017, which claims the benefit of priority of U.S. Provisional Application Ser. No. 62/299,845, filed on Feb. 25, 2016. These priority applications are fully incorporated by reference herein.

BACKGROUND

Routers are frequently utilized in woodworking to cut or form wood into a desired shape or size. These devices typically include a router motor having a rotatable drive shaft that supports a router bit. Examples of applications involving the use of routers include routing, grooving, fluting, shaping and beading. The router bit typically projects upwardly from a hole in the surface of a work table.

Conventionally, routers are either fixed-base or plunge-type. In a fixed-base router, for example, the depth of the router bit is typically adjusted by raising or lowering the router motor using, for example, a rack and pinion. In a plunge-type router, the router motor is typically mounted to several columns that can be actuated to change the depth of the router bit during operation. In some applications, it may be desirable to mount the router to a table or other work surface to support the workpiece as it passes the router bit. A guide mechanism such as a fence may be employed to guide the workpiece along the work surface. Moreover, a guide bushing may also be placed within an opening on a work surface to guide the workpiece around the router bit for certain procedures such as template or inlay cutting.

When performing a woodworking operation, it may become necessary to adjust or replace the router bit. In a conventional table-mounted router, adjustment of the router bit may require the operator to physically remove the router from the router housing in order to access the bit. Once removed, the operator can then loosen the router chuck holding the router bit. In other cases, adjustment of the router bit may require the operator to replace or change the router bit from the underside of the router table, where access is often limited. During this process, the depth setting of the router bit may be compromised, requiring the operator to re-adjust the bit depth prior to continuing the woodworking operation. Since many routers lack an accurate and convenient adjustment mechanism to set the depth of the router bit, such adjustments can often prove difficult and time consuming.

SUMMARY

In one aspect, an apparatus is configured for use with a router. The apparatus comprises a top plate, a carriage, a threaded shaft, a first adjustment mechanism, and a second adjustment mechanism. The carriage is configured to at least partially surround the router. The threaded shaft has a first longitudinal axis, the shaft connecting the top plate and carriage so that the carriage is movable along the first longitudinal axis. Rotation of the first adjustment mechanism about the first longitudinal axis in a first direction and for a number of rotations is configured to rotate the threaded shaft about the first longitudinal axis in the first direction at a first speed. Rotation of the second adjustment mechanism about a second longitudinal axis for the number of rotations is configured to rotate the threaded shaft about the first longitudinal axis in the first direction and at a second speed that is faster than the first speed.

In another aspect, a method is disclosed for using a router lift apparatus. The apparatus comprises a top plate, a carriage, and a threaded shaft. The carriage is configured to at least partially surround the router. The threaded shaft has a first longitudinal axis, the shaft connecting the top plate and carriage so that the carriage is movable along the first longitudinal axis. The method comprises rotating a first adjustment mechanism about the first longitudinal axis in a first direction and for a number of rotations, thereby rotating the threaded shaft about the first longitudinal axis at a first speed. The method also comprises rotating a second adjustment mechanism about a second longitudinal axis for the number of rotations, thereby rotating the threaded shaft about the first longitudinal axis at a second speed that is faster than the first speed.

This disclosure, in its various combinations, either in apparatus or method form, may also be characterized by the following listing of items:

1. An apparatus configured for use with a router, the apparatus comprising:

a top plate;

a carriage configured to at least partially surround the router;

a threaded shaft having a first longitudinal axis, the shaft connecting the top plate and carriage so that the carriage is movable along the first longitudinal axis;

a first adjustment mechanism, wherein rotation of the first adjustment mechanism about the first longitudinal axis in a first direction and for a number of rotations is configured to rotate the threaded shaft about the first longitudinal axis in the first direction at a first speed; and a second adjustment mechanism, wherein rotation of the second adjustment mechanism about a second longitudinal axis for the number of rotations is configured to rotate the threaded shaft about the first longitudinal axis in the first direction and at a second speed that is faster than the first speed.

2. The apparatus of item 1, wherein at least one of the first and second adjustment mechanisms is a socket.

3. The apparatus of any of items 1-2, wherein each of the first and second adjustment mechanisms is located on the top plate.

4. The apparatus of any of items 1-3, wherein the first longitudinal axis is substantially parallel to the second longitudinal axis.

5. The apparatus of any of items 1-4, further comprising a gear assembly configured to translate the rotation of the second adjustment mechanism to the rotation of the threaded shaft.

6. The apparatus of item 5, wherein the gear assembly comprises:

a first circular gear having a first splined perimeter edge; and a second circular gear having a second splined perimeter edge;

wherein the first splined perimeter edge engages with the second splined perimeter edge so that the first circular gear and the second circular gear rotate in opposite directions.

7. The apparatus of any of items 5-6, wherein the gear assembly comprises a first circular gear having a first diameter and a second circular gear having a second diameter different from the first diameter.

8. The apparatus of item 7, wherein the first circular gear and the second circular gear share a rotation axis, a rotation speed and a rotation direction.

9. The apparatus of any of items 1-8, wherein the second speed is at least twice the first speed.
10. An apparatus configured for use with a router, the apparatus comprising:
a top plate having an aperture therein;
a removable insert plate configured to be received in the aperture;
a release mechanism, wherein actuation of the release mechanism releases at least a portion of the removable insert plate from the aperture of the top plate; and
a carriage configured to at least partially surround the router.
11. The apparatus of item 10, wherein the release mechanism comprises:
a button positioned in the top plate; and
a lever positioned below the top plate, wherein downward motion of the button is configured to move a portion of the lever upward against a bottom surface of the removable insert plate.
12. The apparatus of any of items 10-11, wherein the removable insert plate comprises a groove on a perimeter edge thereof, the apparatus further comprising a clip attached to the top plate and configured to fit the groove.
13. A method for using a router lift apparatus, the apparatus comprising:
a top plate;
a carriage configured to at least partially surround a router; and
a threaded shaft having a first longitudinal axis, the shaft connecting the top plate and carriage so that the carriage is movable along the first longitudinal axis of the shaft;
the method comprising:
rotating a first adjustment mechanism about the first longitudinal axis in a first direction and for a number of rotations, thereby rotating the threaded shaft about the first longitudinal axis at the first speed; and
rotating a second adjustment mechanism about a second longitudinal axis for the number of rotations, thereby rotating the threaded shaft about the first longitudinal axis at a second speed that is faster than the first speed.
14. The method of item 13 wherein:
the second adjustment mechanism comprises a socket; and
rotating the second adjustment mechanism about the second longitudinal axis comprises inserting a tool into the socket.
15. The method of any of items 13-14 wherein the top plate comprises a removable insert plate, the method further comprising actuating a release mechanism to release the insert plate from the top plate.
16. The method of item 15, wherein actuating the release mechanism comprises pressing a button positioned in the top plate.
17. The method of any of items 15-16, further comprising manually lifting a released edge of the insert plate from the top plate.
18. The method of any of items 15-17, further comprising pressing an edge of the removable insert plate into an aperture of the top plate to lodge the insert plate in the top plate.
19. The method of item 18, wherein pressing an edge of the removable insert plate into an aperture of the top plate comprises engaging the edge of the removable insert plate with a clip positioned at the aperture of the top plate.
20. The method of any of items 13-19, wherein rotating the second adjustment mechanism about the second longitudinal axis is accomplished in the first direction.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1:
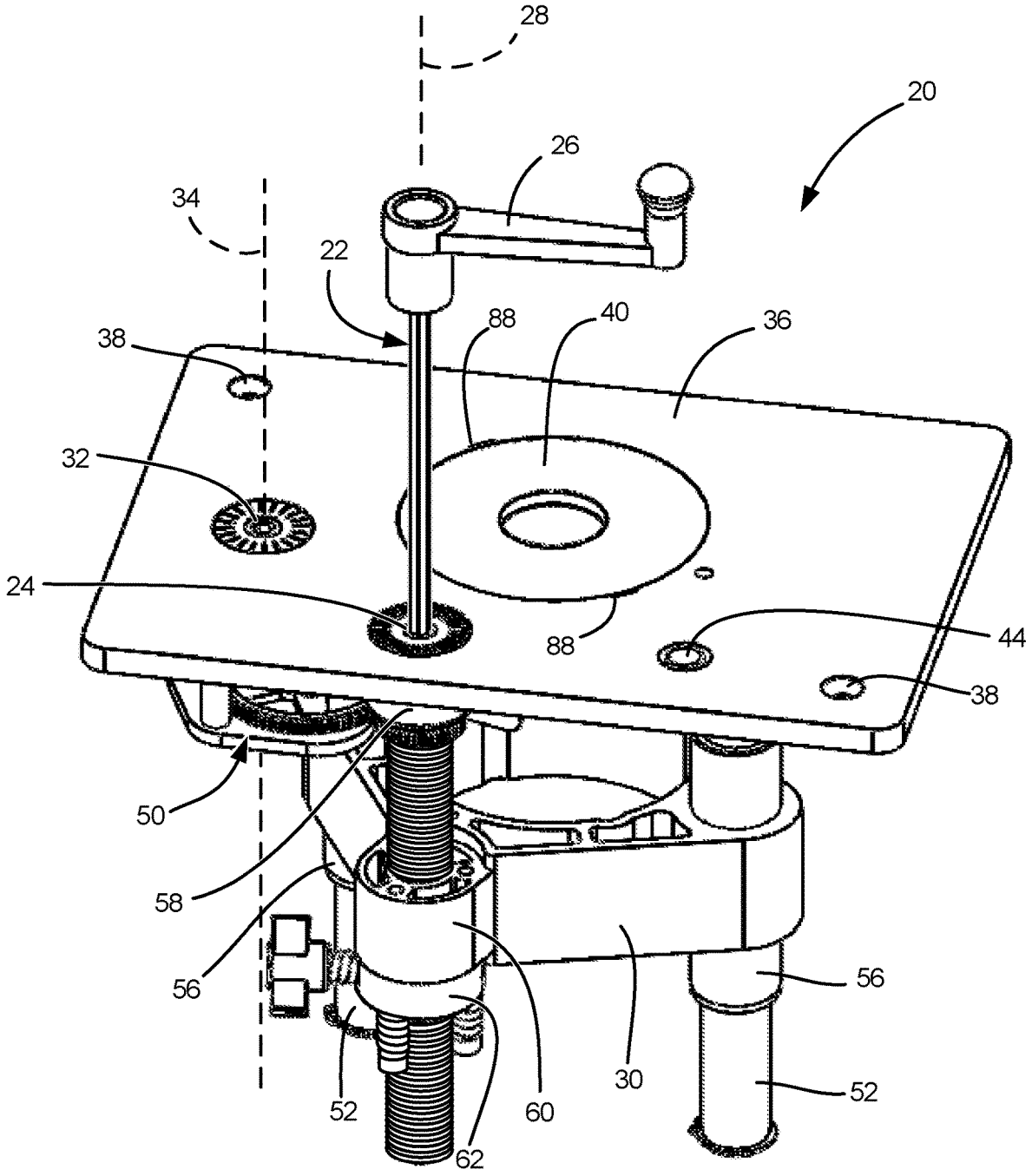
FIG. 1 is a front perspective view of an exemplary router lift apparatus of the present disclosure, with a wrench tool inserted into a first socket fitting for fine height adjustment of the router carriage.

FIG. 1 is a front perspective view of an exemplary embodiment of a router lift apparatus 20 of the present disclosure. Tool 22 is shown fitted into fine adjustment socket 24. Rotation of handle 26 of tool 22 about rotation axis 28 results in raising and lowering router carriage 30 in a vertical direction defined by rotation axis 28. In an alternative method of use, a user may insert tool 22 into quick adjustment socket 32. Rotation of handle 26 about second rotation axis 34 results in raising or lowering router carriage 30 at a faster rate than when tool 22 is used in fine adjustment socket 24. In an exemplary embodiment, each of sockets 24 and 32 is configured with a hexagonal socket to accept a tool 22, which in an exemplary embodiment is a hex wrench. However, it is contemplated that other complimentary socket and tool configurations can also be used.

Router lift 20 includes top plate 36, which is configured to rest on a flange of a work table, as described in U.S. Pat. No. 6,792,984, which is hereby incorporated by reference. To secure top plate 36 to the work table, fasteners such as screws can be inserted into counter sunk-holes 38. Top plate 36 includes a removable insert plate 40 to provide access to a router connected to router lift 20, such as router 42 shown in FIG. 11. Release of insert plate 40 from top plate 36 is facilitated by release button 44, the operation of which will be further explained with reference to FIGS. 7-10.

Router 30 travels vertically along axis 28 of power screw 46, which in an exemplary embodiment is an acme thread power screw. In an exemplary embodiment, a direct drive relation is provided between fine adjustment socket 24 and power screw 46. Thus, rotating tool 22 within fine adjustment socket 24 directly turns power screw 46, the rotation of which causes vertical movement of the threadably attached carriage 30. The rate of vertical movement of carriage 30 due to rotational movement of power screw 46 depends on the size and spacing of the threads on power screw 46. In an exemplary embodiment, a 360° rotation of tool 22 results in a ⅛-inch change in the vertical position of carriage 30.

While such fine vertical adjustment capabilities are desirable for precisely placing a router bit 48 (shown in FIG. 11) relative to a work piece placed upon top plate 36 and the work table, in other cases, it is desirable to more quickly raise and lower carriage 30 and router 42 therein. For example, being able to more quickly adjust the height of router bit 48 may be desirable when changing the bit 48 on the router 42. To more quickly change the vertical position of router carriage 30, one may remove tool 22 from fine adjustment socket 24 and insert tool 22 into quick adjustment socket 32. Gear assembly 50 translates the rotational motion imparted by tool 22 on quick adjustment socket 32, to amplify the effects of a rotation of quick adjustment socket 32. In an exemplary embodiment, gear assembly 50 is configured to raise or lower router carriage 30 at a rate about 4 times that of the direct drive of fine adjustment socket 24.

Figure 6:
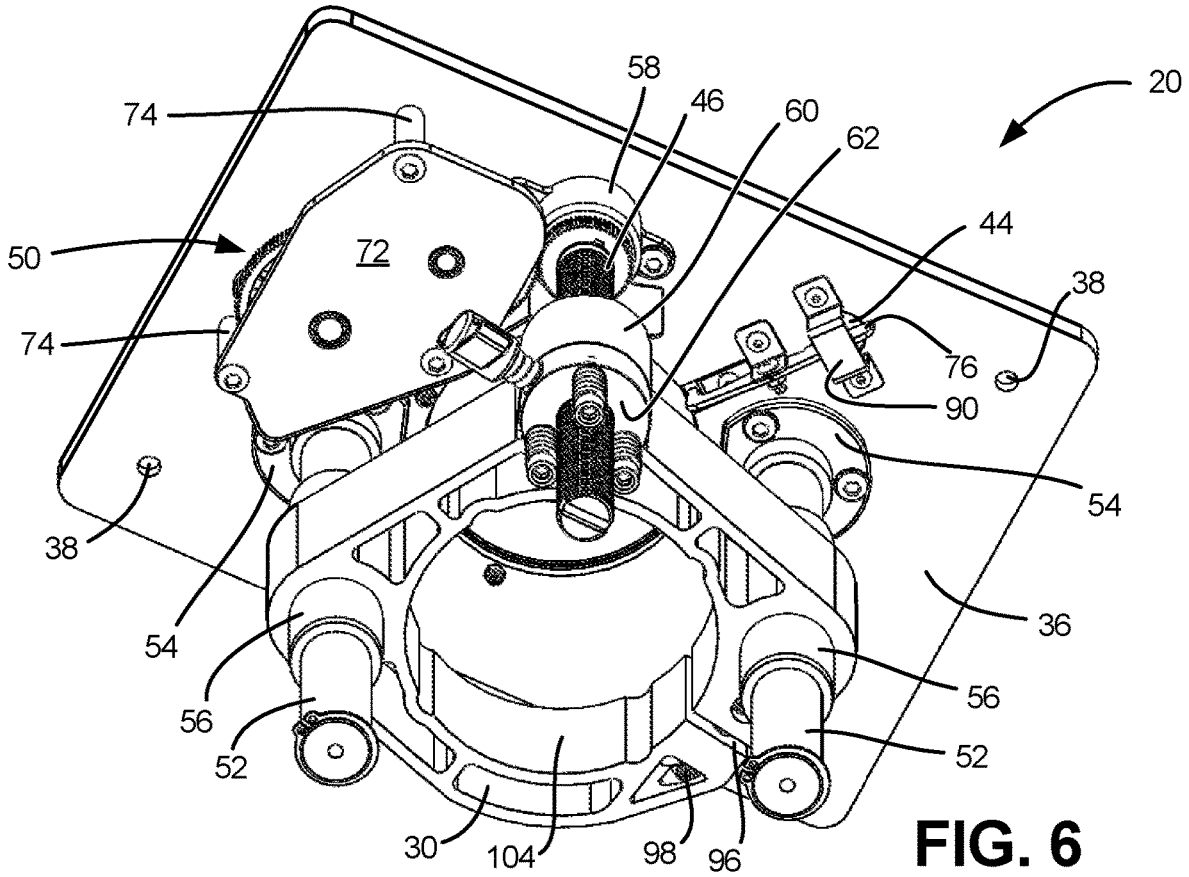
FIG. 6 is a bottom perspective view of the router lift apparatus.

As shown in FIGS. 1 and 6, router carriage 30 is attached to top plate 36 at power screw 46 and columns 52. Columns 52 are attached to a bottom surface of top plate 36 by fasteners such as bolts through flange fittings 54. Bushings 56 allow router carriage 30 to slide along columns 52. Power screw 46 is attached to top plate 36 by a threaded collar 58 and is attached to router carriage 30 by another threaded collar 60.

As shown in FIGS. 1, and 4-6, router carriage 30 is attached to top plate 36 (via power screw 46 and columns 52) at flange fittings 54 and threaded collar 58. It is evident in FIG. 4 that these attachment points are not symmetrical about the generally circular aperture 104 for holding router 42 within router carriage 30. As a result of this arrangement, a router 42 held within router carriage 30 is cantilevered so that a force biases threaded collar 60 in an upward direction along power screw 46. To counter balance this upward bias, threaded collar 60 includes a back-loaded bushing 62. In the illustrated embodiment, threaded bushing 62 is threadably attached to power screw 46 below threaded collar 60. The threaded bushing 62 acts as a spring, exerting a back-loaded spring force on the power screw 46 and threaded collar 60. The spring force of the threaded bushing 62 against the power screw 46 and threaded collar 60 substantially prevents the columns 52 from locking against bushings 56 when power screw 46 is rotated.

Figure 2:
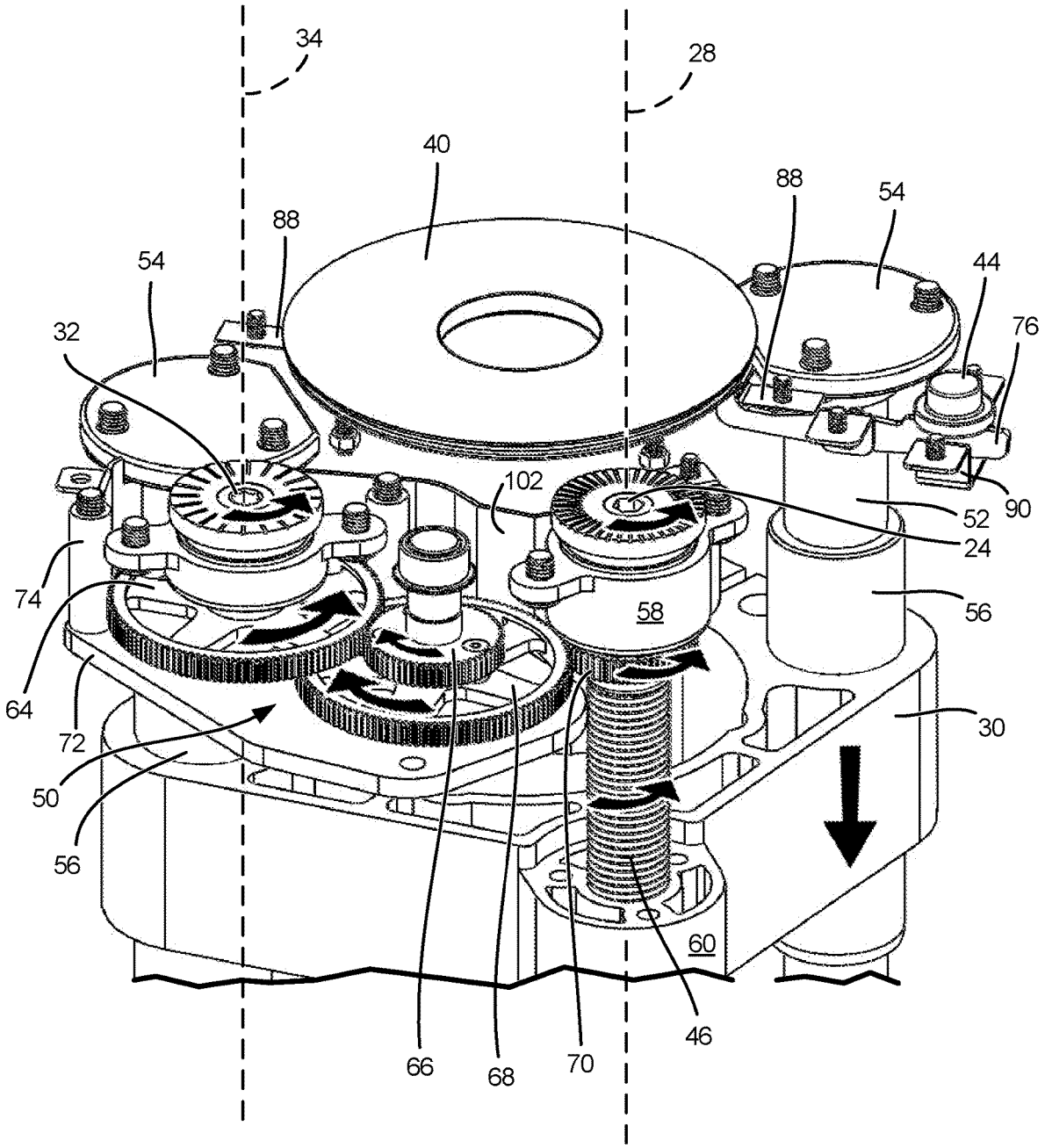
FIG. 2 is a partial top and side perspective view of the lift apparatus of FIG.1, with the top plate removed, illustrating rotational directions of socket fittings, gears and screw components for moving the router carriage in a downward direction.
Figure 3:
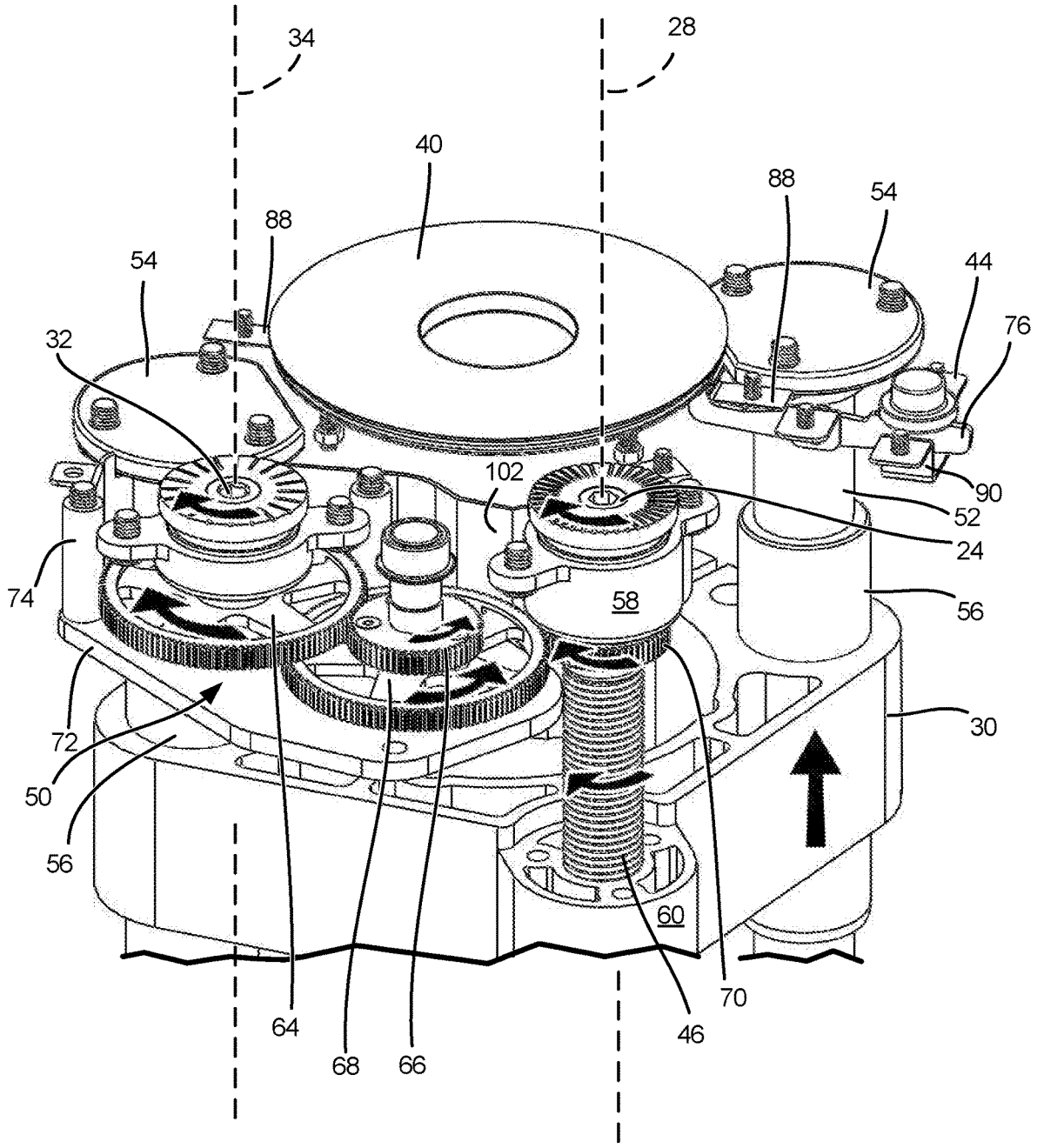
FIG. 3 is similar to FIG. 2 but shows rotational directions for socket fittings, gears and screw components for moving the router carriage in an upward direction.
Figure 4:
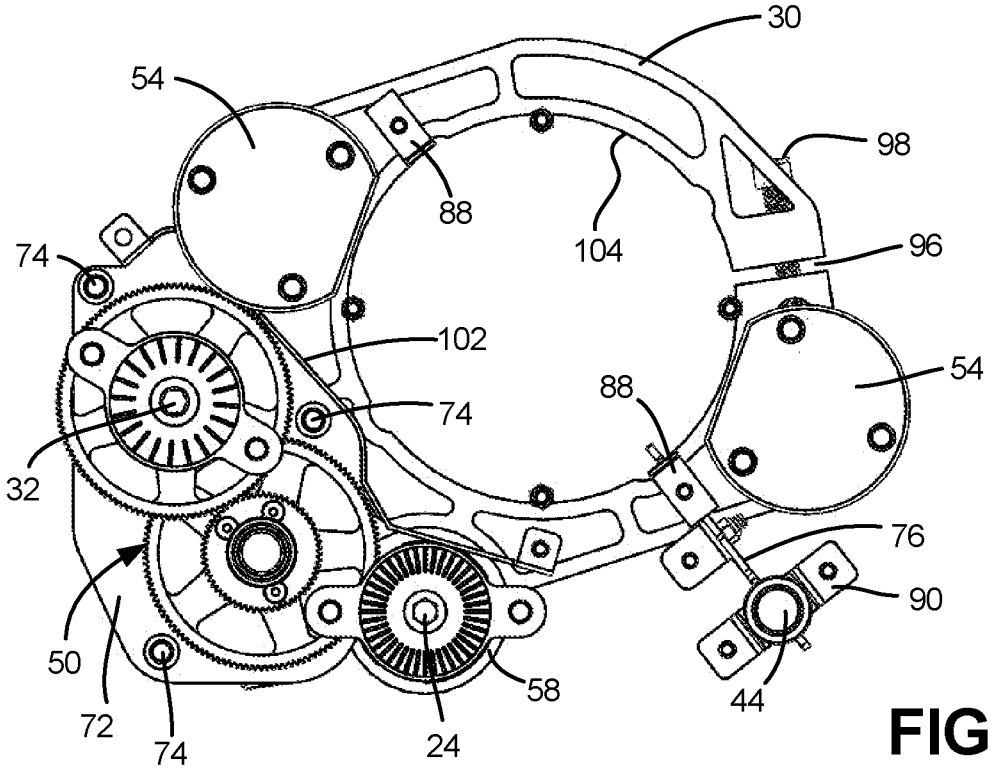
FIG. 4 is a top view of the exemplary router lift apparatus with the top plate and plate insert removed.
Figure 5:
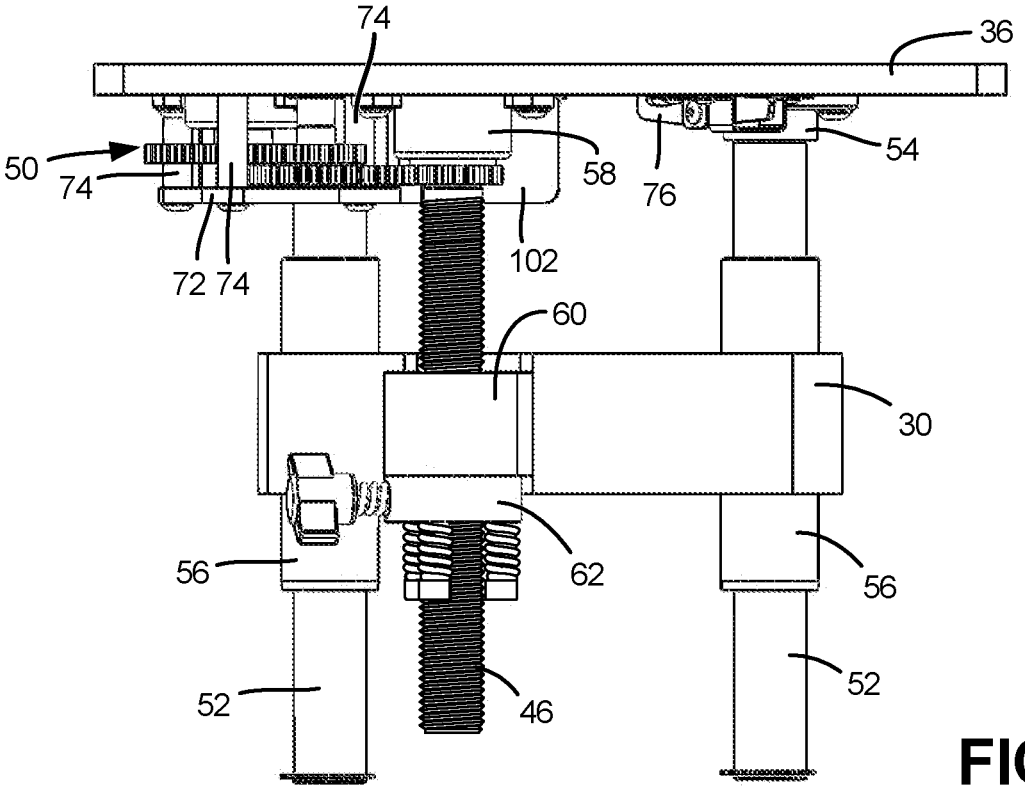
FIG. 5 is a side elevation view of the exemplary router lift apparatus, as viewed from the bottom of FIG. 4.

FIGS. 2 and 3 are partial perspective views of router lift 20, with top plate 36 removed, to allow for a more clear view of gear assembly 50. FIG. 2 shows the interactions of gear assembly 50 and power screw 46 in one exemplary embodiment, wherein the rotation directions shown will result in downward movement of carriage 30. However, it is to be understood that these directions can be reversed by changing the orientation of power screw 46 and/or the directions of the helical threads thereon.

As discussed above, in an exemplary embodiment, fine adjustment socket 24 is a direct drive socket, wherein a 1:1 ratio of drive force is transmitted between the fine adjustment socket 24 and power screw 46. In other words, rotation of fine adjustment socket 24 causes the same speed of rotation of power screw 46. In the illustrated embodiment, rotation of fine adjustment socket 24 in the counter clockwise direction shown by the arrows causes router carriage 30 to move downward. In the exemplary embodiment, a rotation of fine adjustment socket 24 of 360° (e.g., one full rotation) results in the lowering of router carriage 30 by about ⅛ inch in the vertical direction.

In the illustrated embodiment, gear assembly 50 is provided to amplify the rotational force supplied by a user to quick adjustment socket 32. Quick adjustment socket 32 is directly connected to gear 64 to rotate at the same rate therewith. Gear 64 is sized relative to gear 66, so that upon mechanical engagement of the outer splined surfaces thereof, gear 66 turns at twice the speed, and in the opposite direction, as gear 64. In the exemplary embodiment, gears 66 and 68 are coupled to rotate together in the same direction and at the same speed. Gear 68 and gear 70 are mechanically engaged at their outer splined surfaces to turn gear 70 at twice the speed and in the opposite direction as gear 68. Thus, in the exemplary embodiment, gear 70 turns at twice the rate of gear 66, which is twice the rate of quick adjustment socket 32. Accordingly, gear 70 turns in the same direction as quick adjustment socket 32, but at four times the speed. Gear 70 is coupled to rotate power screw 46 at the same speed and in the same direction as gear 70. Accordingly, one full rotation of quick adjustment socket 32 results in spinning power screw 46 at a ratio of four times the direct drive rate, resulting in a downward movement of router carriage 30 of ½ inch (i.e., linear movement of carriage 30 along axis 28 of power screw 46). Thus, it can be seen that gear assembly 50 allows a user to accomplish much quicker changes in the vertical position of carriage 30 for each revolution of the quick adjustment socket 32 as compared to that of the fine adjustment socket 24.

While a particular configuration of gear assembly 50 is shown and described, it is contemplated that other particular arrangements of gears, including different sizes, directions and surface engagements can be devised by those skilled in the art to provide other motion translation ratios between the rotation motion at quick adjustment socket 32 and the vertical motion of router carriage 30. For example, while a 4:1 ratio is described herein, it is contemplated that other ratios such as 3:1 and 5:1 could also be used, as well as other ratios not specifically mentioned. Such other ratios would be accomplished by varying the sizes, numbers, and engagement surfaces of the gears within gear assembly 50.

FIG. 3 is similar to FIG. 2, but shows that rotation of either of adjustment sockets 24 of 32 in a direction opposite of that shown in FIG. 2 leads to vertical travel of router carriage 30 in the opposite direction (i.e., upward), as compared to FIG. 2. In an exemplary embodiment, the rotation axes of all gears 64, 66, 68 and 70 are coincident or parallel with the rotation axis 26 of fine adjustment socket 24 and/or the rotation axis 34 of quick adjustment socket 32.

Figure 12:
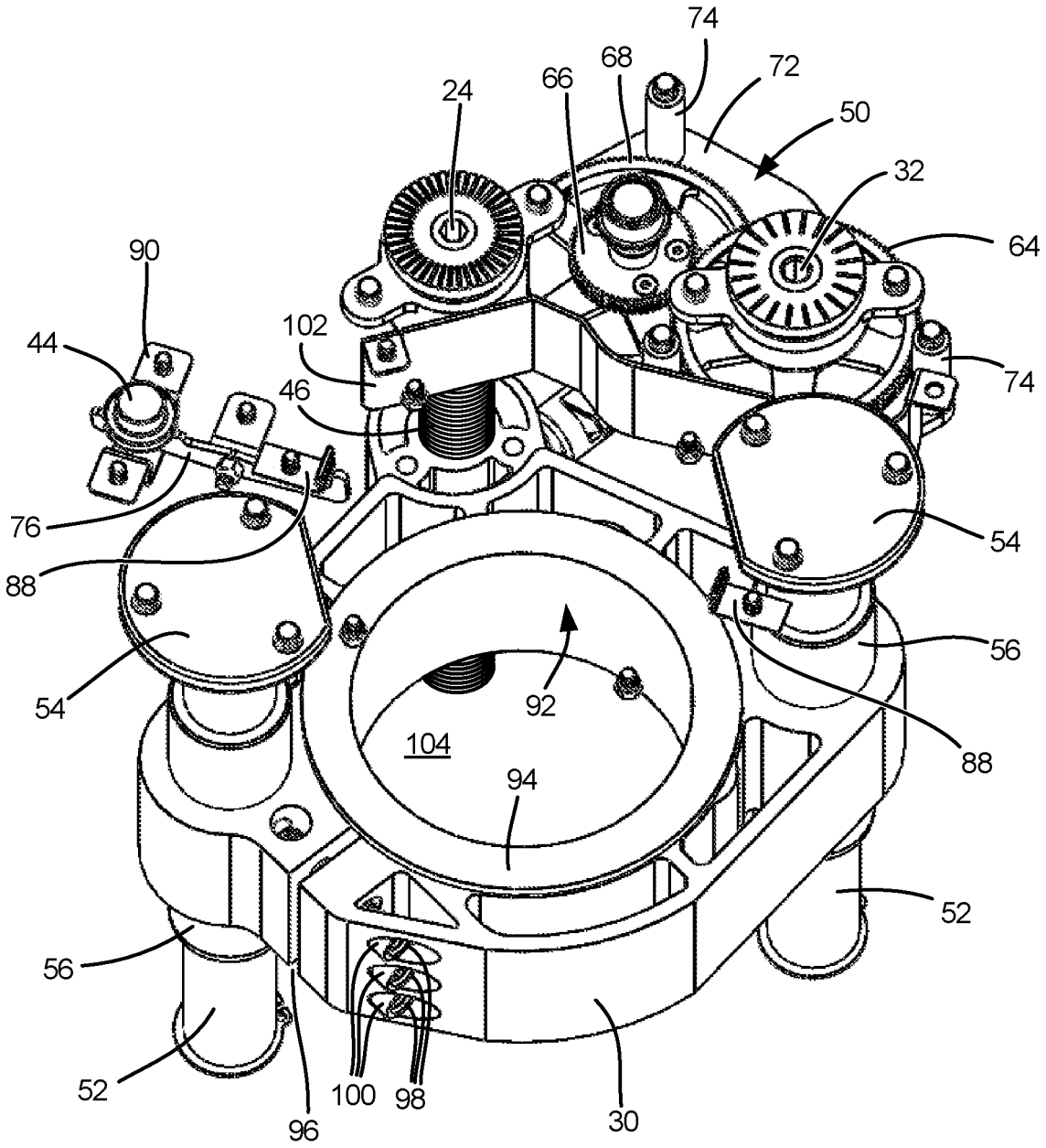
FIG. 12 is a back and top perspective view of the router lift apparatus with the top plate removed, and with the addition of an optional router sleeve.

As shown in FIGS. 2, 3 and 6, in an exemplary embodiment, gear assembly 50 is supported under top plate 36 by gear plate 72, which is attached to a bottom surface of top plate 36 by columns 74. In an exemplary embodiment, a protective enclosure can be provided around gear plate 72 and columns 74 to protect gears 64, 66, 68 from dust, debris and other contaminants that may result from the use of router bit 42. FIG. 12 shows wall 102, which extends downward from top plate 36 and connects to gear floor 72 to isolate gear assembly 50 from saw dust and other debris that may result from the use of router 42. Wall 102 can also be seen in FIGS. 2-5.

FIGS. 7-10 illustrate the use of a mechanism for easily removing insert plate 40 from top plate 36. A user can actuate the insert plate removal mechanism by pushing downward on release button 44, thereby pushing downward on one side of lever 76, causing an opposite end of lever 76 to push upward on a bottom surface of insert plate 40. While FIGS. 8A and 9A are cross-sectional views, taken along line A-A of FIG. 7; and FIGS. 8B and 9B are cross-sectional views, taken along line B-B of FIG. 7, cross hatching of the sections is omitted for clarity of the illustration. Moreover, while one column of 52 and its associated flange fitting 54 are shown, most of the other structures under top plate 36 are omitted for clarity. In an exemplary embodiment, release button 44 is a generally cylindrically shaped member having a small range of motion along longitudinal axis 78. Downward movement of release button 44 presses upon a top surface of a first end 80 of lever 76, thereby causing it to pivot about pivot point 82, to thereby cause a second end 84 of lever 76 to move upward. The second end 84 of lever 76 pushes upon a bottom surface of insert plate 40, thereby dislodging a perimeter edge 86 of insert plate 40 from a correspondingly shaped clip 88 connected to top plate 36.

Figure 7:
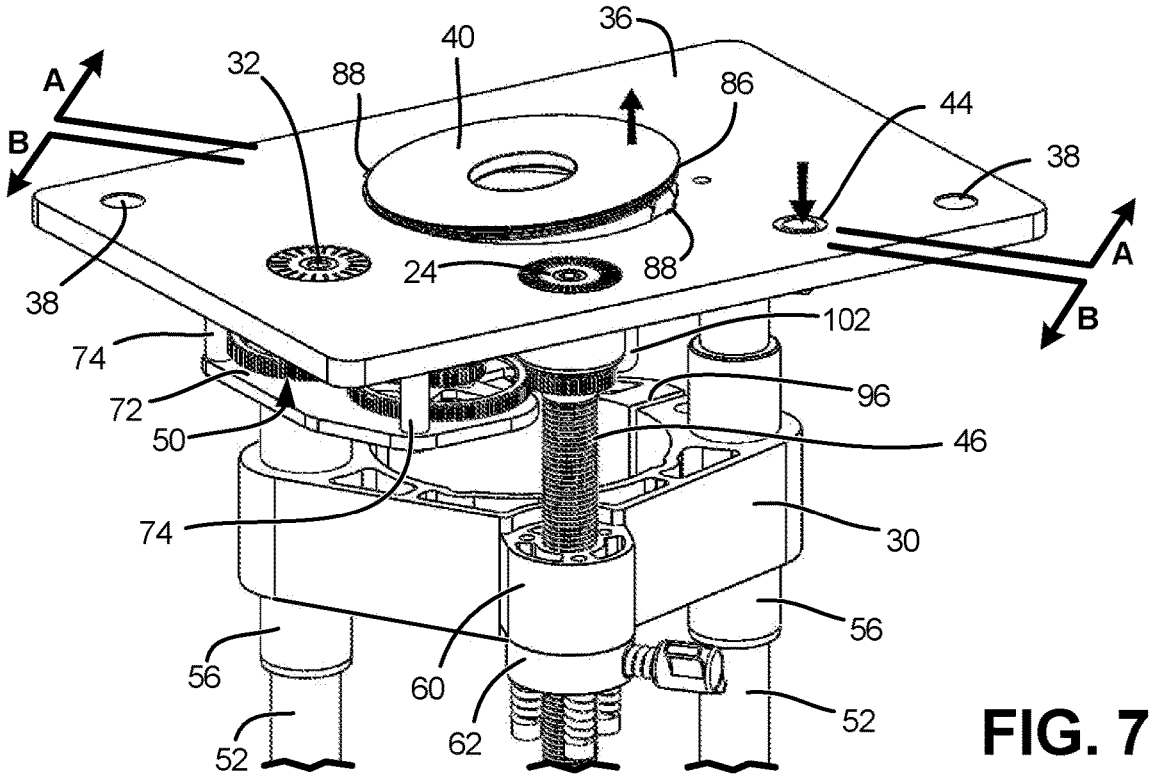
FIG. 7 is a partial perspective view, showing the use of a plate release button for disengaging the plate insert.
Figure 8A:
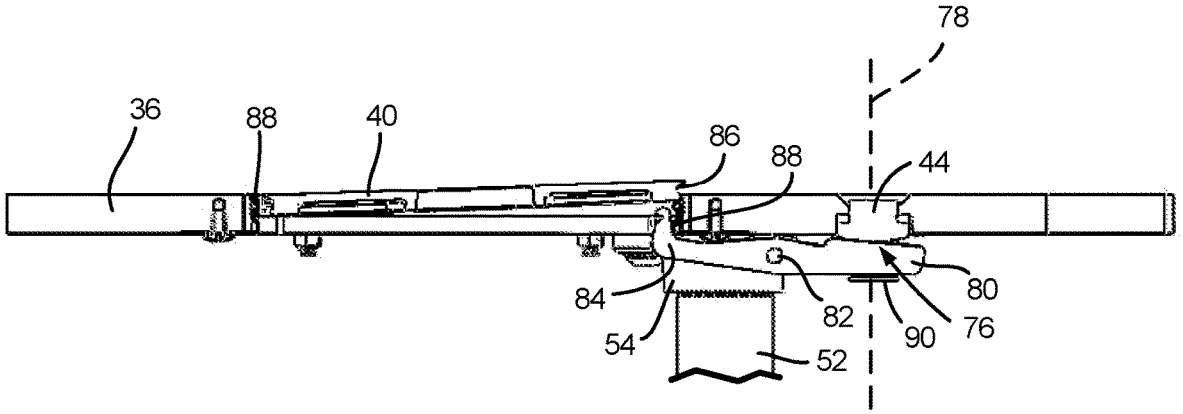
FIG. 8A is a cross-sectional view of the plate and latch assembly, taken along line A-A of FIG. 7.
Figure 8B:
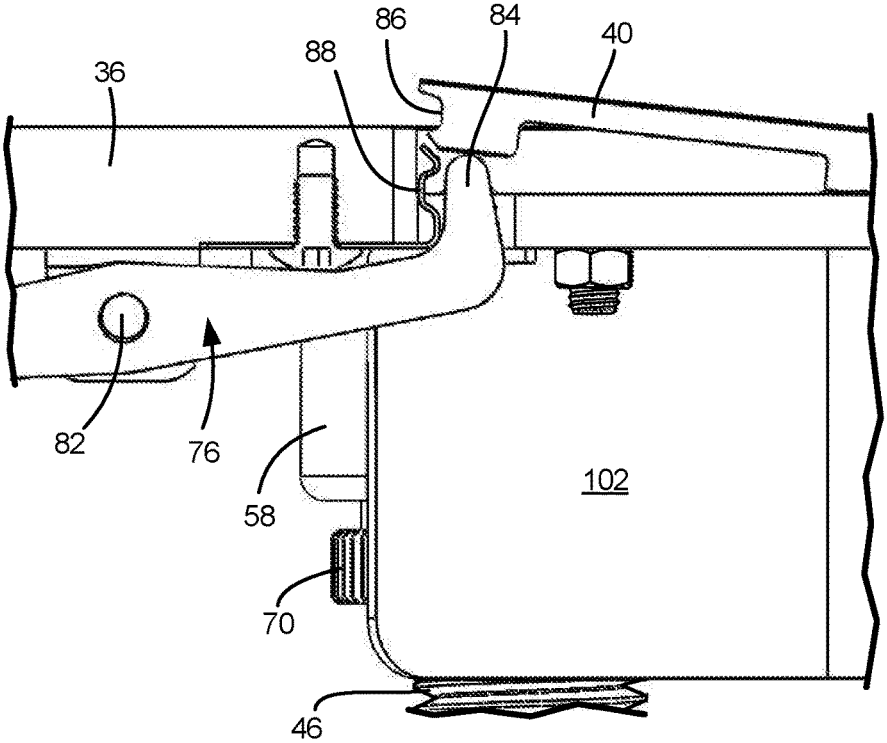
FIG. 8B is a partial, enlarged cross-sectional view of the plate and latch assembly, taken along line B-B of FIG. 7.
Figure 9A:
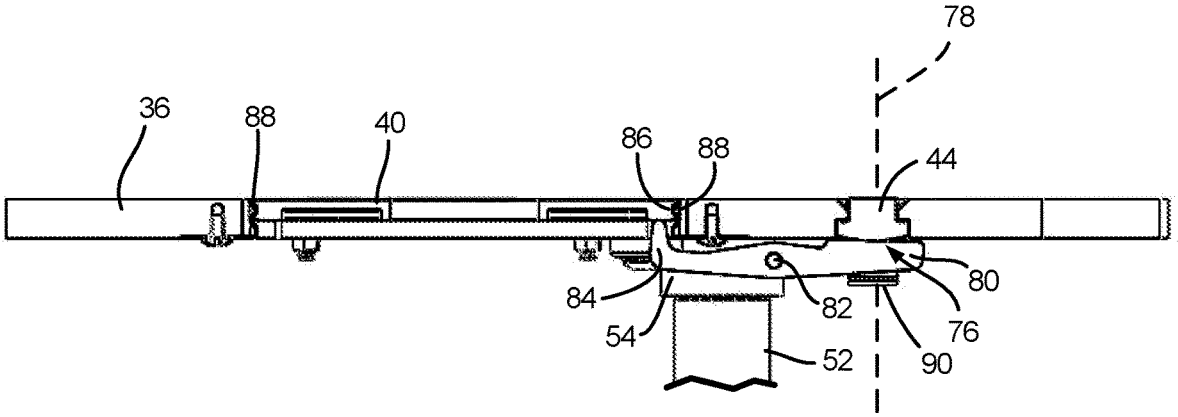
FIG. 9A is similar to FIG. 8A, but shows the insert plate pushed downward to seat within the top plate of the router lift apparatus, as shown in FIG. 1.
Figure 9B:
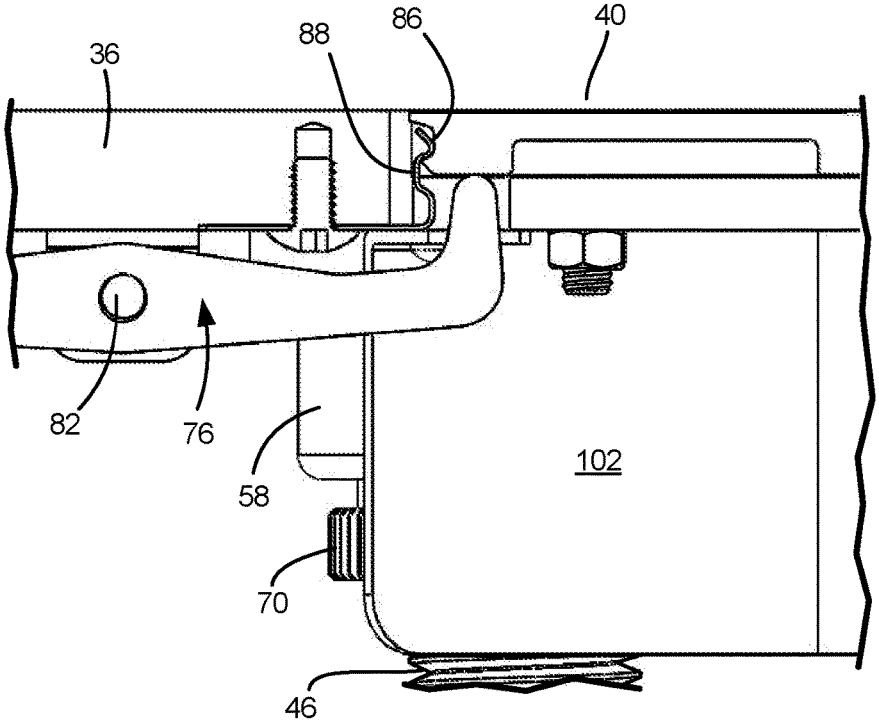
FIG. 9B is similar to FIG. 8B, but shows the insert plate pushed downward to seat within the top plate of the router lift apparatus, as shown in FIG. 1.
Figure 10:
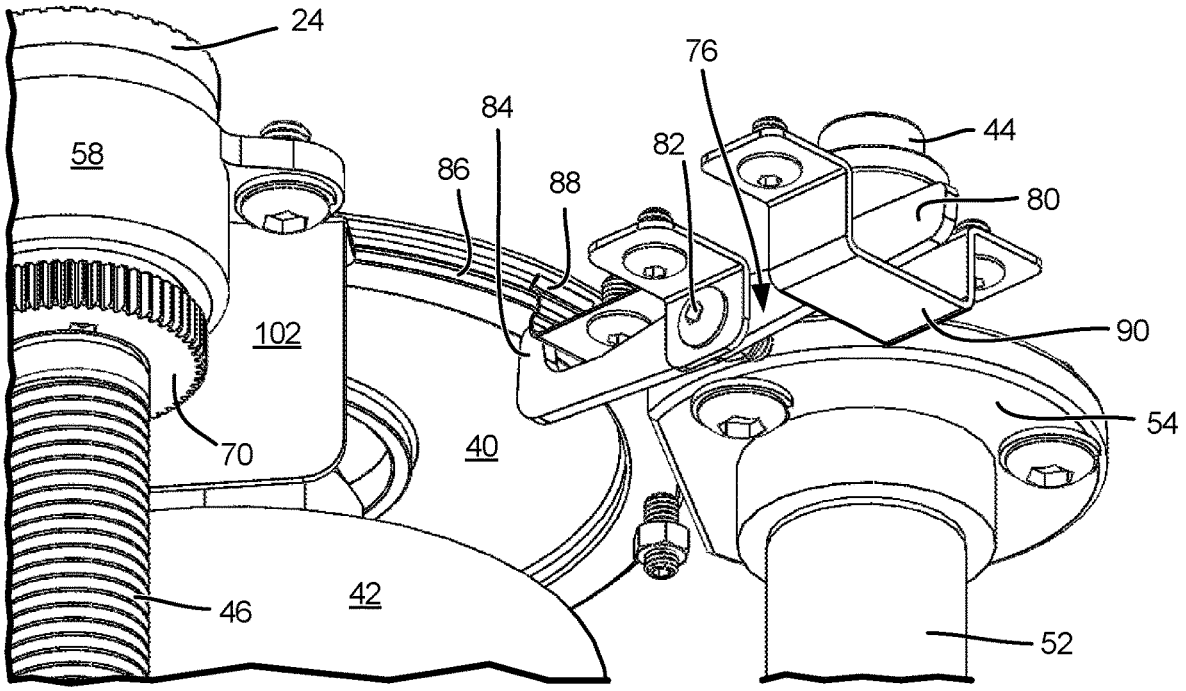
FIG. 10 is a partial bottom perspective view of the insert plate and latch component in the closed position of FIGS. 1 and 9.

As shown in FIG. 7, once insert plate 40 is disengaged from top plate 36, a user can insert a finger, for example, under perimeter edge 86 to lift and remove insert plate 40. As shown in FIGS. 9A and 9B, to reinsert plate 40 into top plate 36, the user presses downward upon insert plate 40, so that perimeter edge 86 is again engaged with clip 88. Such motion pushes downward on end 84 of lever 76, causing pivotal motion that then raises the first end 80 of lever 76, thereby pushing release button 44 back up to the position shown in FIGS. 9A and 9B. As shown in FIG. 10, clip 88 is preferably a resilient member contoured to provide a snap fit with the perimeter edge 86 of insert plate 40. In an exemplary embodiment, clip 88 is formed of spring steel. FIG. 10 does not show top plate 36, to allow for a view of the fasteners used to secure clip 88 and lever 76 to a bottom surface of top plate 36. Bracket 90 is also secured to a bottom surface of top plate 36 and provides a means for limiting the downward motion of first end 80 and release button 44.

In an exemplary embodiment, perimeter edge 86 of insert plate 40 includes a groove, and clip 88 is configured to project into and engage that groove when the router plate insert 40 is inserted into top plate 36, as shown in FIGS. 9A and 9B. Router plate insert 40 can be removed from top plate 36 to allow for easier replacement for router bit 48 or to allow a differently configured router plate insert to be placed into top plate 36, such as an insert having a differently shaped central aperture. An advantage of the illustrated embodiment is that no additional tools are needed for removal or replacement of insert plate 40 in top plate 36. As shown in the illustrated embodiment, two diametrically opposed clips 88 are provided to engage with insert plate 40. However, it is understood that more or fewer clips can be used.

Figure 11:
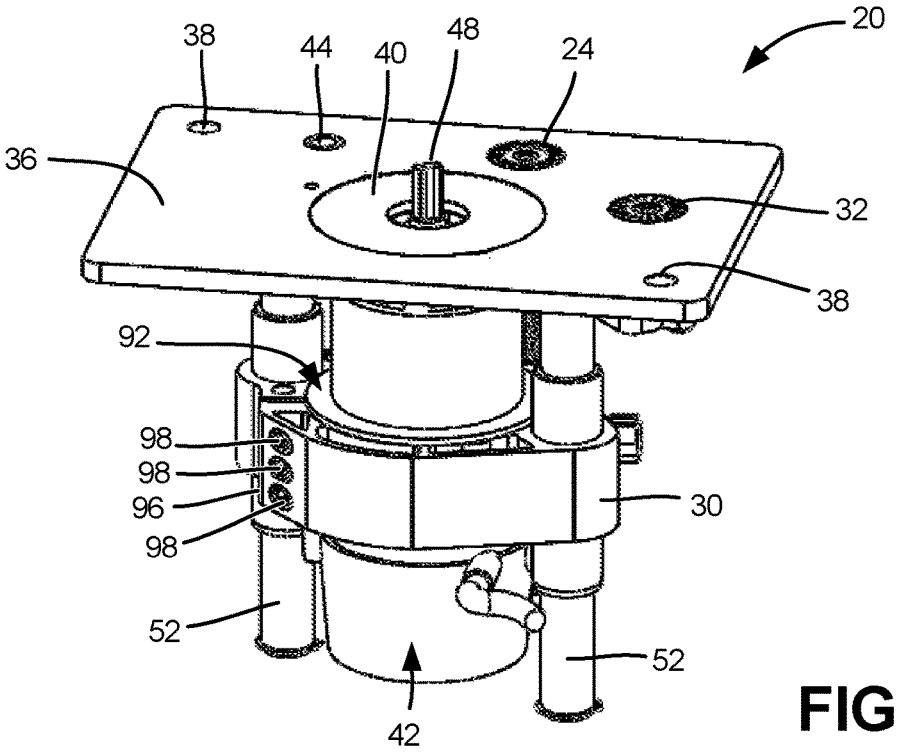
FIG. 11 is a back perspective view of the router lift apparatus with a router attached thereto.

FIG. 11 shows a back perspective view of lift 20 with router 42 secured therein. In an exemplary embodiment, a gap 96 is provided between frame pieces of the router carriage 30. The width of this gap 96 can be increased or decreased by tightening or loosening fasteners 98 within threaded bores 100 to allow for the insertion, securement, and removal of router 42.

FIG. 12 is a back and top perspective view of router lift 20 with top plate 36 removed, and with the addition of optional router sleeve 92. Because routers 42 come in different sizes, some routers will fit snuggly into the aperture 104 defined by router carriage 30. In other cases, the diameter of the router body may be slightly small for the router carriage 30. In those cases, a compressible router sleeve insert 92 may be positioned within carriage 30 to provide a better fit when a router 42 is installed in the lift apparatus 20. In the illustrated embodiment, sleeve 92 has a generally cylindrical configuration with a radially extending flange 94 on a top edge thereof, to prevent sleeve 92 from falling through aperture 104 of carriage 30. Different sleeves 92 having different dimensions can be provided to allow lift apparatus 20 to be used with a variety of routers of different sizes. Generally, a material forming sleeve 92 is flexible and slightly compressible to form a tight fit that also dampens vibrations. Moreover, the material for sleeve 92 can allow for heat dissipation from router 42.

Exemplary, non-limiting features are described below. An apparatus 20 is configured for use with a router 42. The apparatus 20 comprises a top plate 36 and a carriage 30 configured to at least partially surround the router 42. A threaded shaft 46 has a first longitudinal axis 28, the shaft 46 connecting the top plate 36 and carriage 30 so that the carriage 30 is movable along the first longitudinal axis 28. Rotation of a first adjustment mechanism 24 about the first longitudinal axis 28 in a first direction and for a number of rotations is configured to rotate the threaded shaft 46 about the first longitudinal axis 28 in the first direction at a first speed. Rotation of a second adjustment mechanism 32 about a second longitudinal axis 34 for the same number of rotations is configured to rotate the threaded shaft 46 about the first longitudinal axis 28 in the first direction and at a second speed that is faster than the first speed. In an exemplary embodiment, the second speed is at least twice the first speed.

In an exemplary embodiment, at least one of the first and second adjustment mechanisms 24, 32 is a socket. In an exemplary embodiment, each of the first and second adjustment mechanisms 24, 32 is located on the top plate 36. In an exemplary embodiment, the first longitudinal axis 28 is substantially parallel to the second longitudinal axis 34.

In an exemplary embodiment, a gear assembly 50 is configured to translate the rotation of the second adjustment mechanism 34 to the rotation of the threaded shaft 46. In an exemplary embodiment, the gear assembly 50 comprises a first circular gear 64, 66, 68, 70 having a first splined perimeter edge and a second circular gear (another of 64, 66, 68, 70) having a second splined perimeter edge. The first splined perimeter edge engages with the second splined perimeter edge so that the first circular gear and the second circular gear rotate in opposite directions (for example, gears sets (64, 66) and (68, 70)). In an exemplary embodiment, gears 64 and 68 have approximately the same diameter as each other, and gears 66 and 70 have approximately the same diameter as each other, where gears 64 and 68 are about twice as big as gears 66 and 70. Quick adjustment socket 32 and gear 64 share a common rotation axis 34, a common rotation speed, and a common rotation direction. Gear 66 and 68 share a common rotation axis, a common rotation speed, and a common rotation direction. Fine adjustment socket 24 and gear 70 share a common rotation axis 28, a common rotation speed, and a common rotation direction. In an exemplary embodiment, the second speed is at least twice the first speed.

In an exemplary embodiment, the top plate 36 comprises a removable insert plate 40, the apparatus further comprising a release mechanism, wherein actuation of the release mechanism releases the insert plate 40 from the top plate 36. In an exemplary embodiment, the release mechanism comprises a button 44 positioned in the top plate 36 and a lever 76 positioned below the top plate 36, wherein downward motion of the button 44 is configured to move a portion 84 of the lever 76 upward against a bottom surface of the insert plate 40. In an exemplary embodiment, the removable insert plate 40 comprises a groove on a perimeter edge 86 thereof, the apparatus 20 further comprising a clip 88 attached to the top plate 36 and configured to fit the groove.

In an exemplary embodiment, a method for using a router lift apparatus comprises rotating a first adjustment mechanism 24 about a first longitudinal axis 28 in a first direction and for a number of rotations, thereby rotating a threaded shaft 46 about the first longitudinal axis 28 at the first speed or rate of rotation; and rotating a second adjustment mechanism 34 about a second longitudinal axis 38 for the number of rotations, thereby rotating the threaded shaft 46 about the first longitudinal axis 28 at a second speed or rate of rotation that is faster than the first speed or rate of rotation. In an exemplary embodiment, the second adjustment mechanism 32 comprises a socket; and rotating the second adjustment mechanism 32 about the second longitudinal axis 34 comprises inserting a tool 22 into the socket. In an exemplary embodiment, rotating the second adjustment mechanism 32 about the second longitudinal axis 34 is accomplished in the first direction.

In an exemplary embodiment, the top plate 36 comprises a removable insert plate 40, the method further comprising actuating a release mechanism to release the insert plate 40 from the top plate 36. In an exemplary embodiment, actuating the release mechanism comprises pressing a button 44 positioned in the top plate 36. The method further comprises manually lifting a released edge 86 of the insert plate 40 from the top plate 36. To lodge the insert plate 40 back into the top plate 36, the user presses an edge 86 of the removable insert plate 40 into an aperture of the top plate 36, thereby engaging the edge 86 of the removable insert plate 40 with a clip 88 positioned at the aperture of the top plate 36.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

What is claimed is:

1. An apparatus configured for use with a router, the apparatus comprising:

a top plate;

a carriage configured to at least partially surround the router;

a threaded shaft having a first longitudinal axis, the shaft connecting the top plate and carriage so that the carriage is movable along the first longitudinal axis;

a first adjustment mechanism, wherein rotation of the first adjustment mechanism about the first longitudinal axis in a first direction and for a number of rotations is configured to rotate the threaded shaft about the first longitudinal axis in the first direction at a first speed; and a second adjustment mechanism, wherein rotation of the second adjustment mechanism about a second longitudinal axis for the number of rotations is configured to rotate the threaded shaft about the first longitudinal axis in the first direction and at a second speed that is faster than the first speed;

wherein each of the first and second adjustment mechanisms is located on the top plate.

2. The apparatus of claim 1, wherein at least one of the first and second adjustment mechanisms is a socket.

3. The apparatus of claim 1, further comprising a gear assembly configured to translate the rotation of the second adjustment mechanism to the rotation of the threaded shaft.

4. An apparatus configured for use with a router, the apparatus comprising:

a top plate;

a carriage configured to at least partially surround the router;

a threaded shaft having a first longitudinal axis, the shaft connecting the top plate and carriage so that the carriage is movable along the first longitudinal axis;

a first adjustment mechanism, wherein rotation of the first adjustment mechanism about the first longitudinal axis in a first direction and for a number of rotations is configured to rotate the threaded shaft about the first longitudinal axis in the first direction at a first speed;

a second adjustment mechanism, wherein rotation of the second adjustment mechanism about a second longitudinal axis for the number of rotations is configured to rotate the threaded shaft about the first longitudinal axis in the first direction and at a second speed that is faster than the first speed; and a gear assembly configured to translate the rotation of the second adjustment mechanism to the rotation of the threaded shaft, wherein the gear assembly comprises:

a first circular gear having a first splined perimeter edge; and a second circular gear having a second splined perimeter edge;

wherein the first splined perimeter edge engages with the second splined perimeter edge so that the first circular gear and the second circular gear rotate in opposite directions.

5. The apparatus of claim 1, wherein the second speed is at least twice the first speed.

6. A method for using a router lift apparatus, the apparatus comprising:

a top plate;

a carriage configured to at least partially surround a router; and a threaded shaft having a first longitudinal axis, the shaft connecting the top plate and carriage so that the carriage is movable along the first longitudinal axis of the shaft;

the method comprising:

rotating a first adjustment mechanism about the first longitudinal axis in a first direction and for a number of rotations, thereby rotating the threaded shaft about the first longitudinal axis at a first speed, by inserting a tool into a first socket of the first adjustment mechanism;

removing the tool from the first socket; and rotating a second adjustment mechanism about a second longitudinal axis for the number of rotations, thereby rotating the threaded shaft about the first longitudinal axis at a second speed that is faster than the first speed, by inserting the tool into a second socket of the second adjustment mechanism.

7. The method of claim 6 wherein the top plate comprises a removable insert plate, the method further comprising actuating a release mechanism to release the insert plate from the top plate.

8. The method of claim 7, wherein actuating the release mechanism comprises pressing a button positioned in the top plate.

9. The method of claim 7, further comprising manually lifting a released edge of the insert plate from the top plate.

10. The method of claim 7, further comprising pressing an edge of the removable insert plate into an aperture of the top plate to lodge the insert plate in the top plate.

11. The method of claim 10, wherein pressing an edge of the removable insert plate into an aperture of the top plate comprises engaging the edge of the removable insert plate with a clip positioned at the aperture of the top plate.

12. The method of claim 6, wherein rotating the second adjustment mechanism about the second longitudinal axis is accomplished in the first direction.

13. The apparatus of claim 1, comprising:

an aperture in the top plate;

a removable insert plate configured to be received in the aperture; and a release mechanism, wherein actuation of the release mechanism releases at least a portion of the removable insert plate from the aperture of the top plate.

14. The apparatus of claim 4, wherein at least one of the first and second adjustment mechanisms is a socket.

15. The apparatus of claim 4, wherein the second speed is at least twice the first speed.

16. The apparatus of claim 4, comprising:

an aperture in the top plate;

a removable insert plate configured to be received in the aperture; and a release mechanism, wherein actuation of the release mechanism releases at least a portion of the removable insert plate from the aperture of the top plate.

* * * * *